United States Patent [19]

Hannebaum

[11] 4,332,235

[45] Jun. 1, 1982

[54] ROTATING AIR DRAFT FIREPLACE

[76] Inventor: Harold W. Hannebaum, P.O. Box H, Shoshone, Id. 83352

[21] Appl. No.: 133,210

[22] Filed: Mar. 24, 1980

Related U.S. Application Data

[63] Continuation-in-part of Ser. No. 943,842, Sep. 19, 1978, Pat. No. 4,273,096, which is a continuation-in-part of Ser. No. 843,827, Oct. 20, 1977, Pat. No. 4,181,117, which is a continuation-in-part of Ser. No. 762,014, Jan. 24, 1977, abandoned.

[51] Int. Cl.[3] ..... F24B 1/18

[52] U.S. Cl. ..... 126/120; 126/146; 126/164

[58] Field of Search ..... 126/120, 121, 123, 126, 126/298, 164, 165, 146; D23/96, 97; D7/207, 211; 211/60 R; 108/91

[56] References Cited

U.S. PATENT DOCUMENTS

| | | | |
|---|---|---|---|
| 237,750 | 2/1881 | Johnston | 126/164 |
| 3,339,540 | 9/1967 | Kreider | 126/164 X |
| 3,499,432 | 3/1970 | Hannebaum | 126/120 |
| 4,156,418 | 5/1979 | Berg | 126/120 |
| 4,176,652 | 12/1979 | Berg | 126/120 X |

*Primary Examiner*—Samuel Scott
*Assistant Examiner*—Randall L. Green
*Attorney, Agent, or Firm*—Howard I. Podell

[57] ABSTRACT

An enclosed fireplace of circular cross-section mounted on a pedestal in which air is drawn into the fire chamber from spaced vertical air intake tubes mounted about the periphery of the fire chamber. A free standing wood holder rests on the center of the fire chamber and is formed of spaced horizontal concentric rings joined to a plurality of vertical legs, each leg being in the shape of a flat vane. The legs are oriented so that each of the vanes extend in a common circular direction away from the external perimeter of the rings, at an angle to the radius of the rings at the juncture of the vanes to the rings so as to impart a rotational torque to draft air passing by said vanes into the interior of the rings. The rings are of a size to contain one or more pieces of firewood with each piece preferably oriented along its vertical axis. The air intake tubes are preferably joined to a common air intake that enters through the bottom of the fireplace pedestal.

7 Claims, 4 Drawing Figures

ROTATING AIR DRAFT FIREPLACE

This invention is a continuation-in-part of co-pending application Ser. No. 943,842, now U.S. Pat. No. 4,273,096 filed on Sept. 19, 1978, which application is a continuation-in-part of application Ser. No. 843,827, now U.S. Pat. No. 4,181,117 filed on Oct. 20, 1977, which is a continuation-in-part of abandoned application Ser. No. 762,014 filed on Jan. 24, 1977. Application Ser. No. 843,827 has been issued as U.S. Pat. No. 4,181,117.

BACKGROUND OF THE INVENTION

Circular enclosed fireplaces have been known in the art. U.S. Pat. No. 3,499,432 describes such a fireplace which I invented and discloses means to impart a rotational motion to intake air to produce a beautiful lighting effect, while at the same time keeping the external windows of the enclosure free of soot. Other circular fireplaces are disclosed in U.S. Pat. Nos. 3,515,122; 3,809,058; 3,768,457; 4,156,418; 3,910,251; and 4,112,913; and 3,260,256. U.S. Pat. No. 4,131,108 discloses an andiron for standing logs in a fire chamber.

SUMMARY OF THE INVENTION

My invention is an enclosed fireplace of circular cross-section mounted on a pedestal in which air is drawn into the fire chamber from spaced vertical air inake tubes mounted about the periphery of the fire chamber. A free standing wood holder rests on the center of the fire chamber and is formed of spaced horizontal concentric rings joined to a plurality of vertical legs, each leg being in the shape of a flat vane. The legs are oriented so that each of the vanes extend in a common circular direction away from the external perimeter of the rings, at an angle to the radius of the rings, at the juncture of the vanes to the rings, so as to impart a rotational torque to draft air passing by said vanes into the interior of the rings. The rings are of a size to contain one or more pieces of firewood with each piece preferably oriented along its vertical axis. The air intake tubes are preferably joined to a common air intake that enters through the bottom of the fireplace pedestal.

This invention improves on the advantages of my previous fireplace inventions by imparting a rotational torque to the intake air as it directly approaches the center of the fire chamber, so as to evenly feed the flames of vertically stacked firewood. This rotational torque is imparted to the intake air by the vanes of the shaped wood holder, with the spaced rings of the wood holder serving to maintain the firewood along a vertical axis so as to distribute the bulk of the radiant heat from the flaming firewood through the transparent walls of the enclosure of the fire chamber.

The vertical air intake tubes, by being joined to a common central intake duct, permit intake air to be drawn into the fireplace from below the floor of the fireplace or from a duct that extends through a side wall of the room in which the fireplace is mounted.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 4:
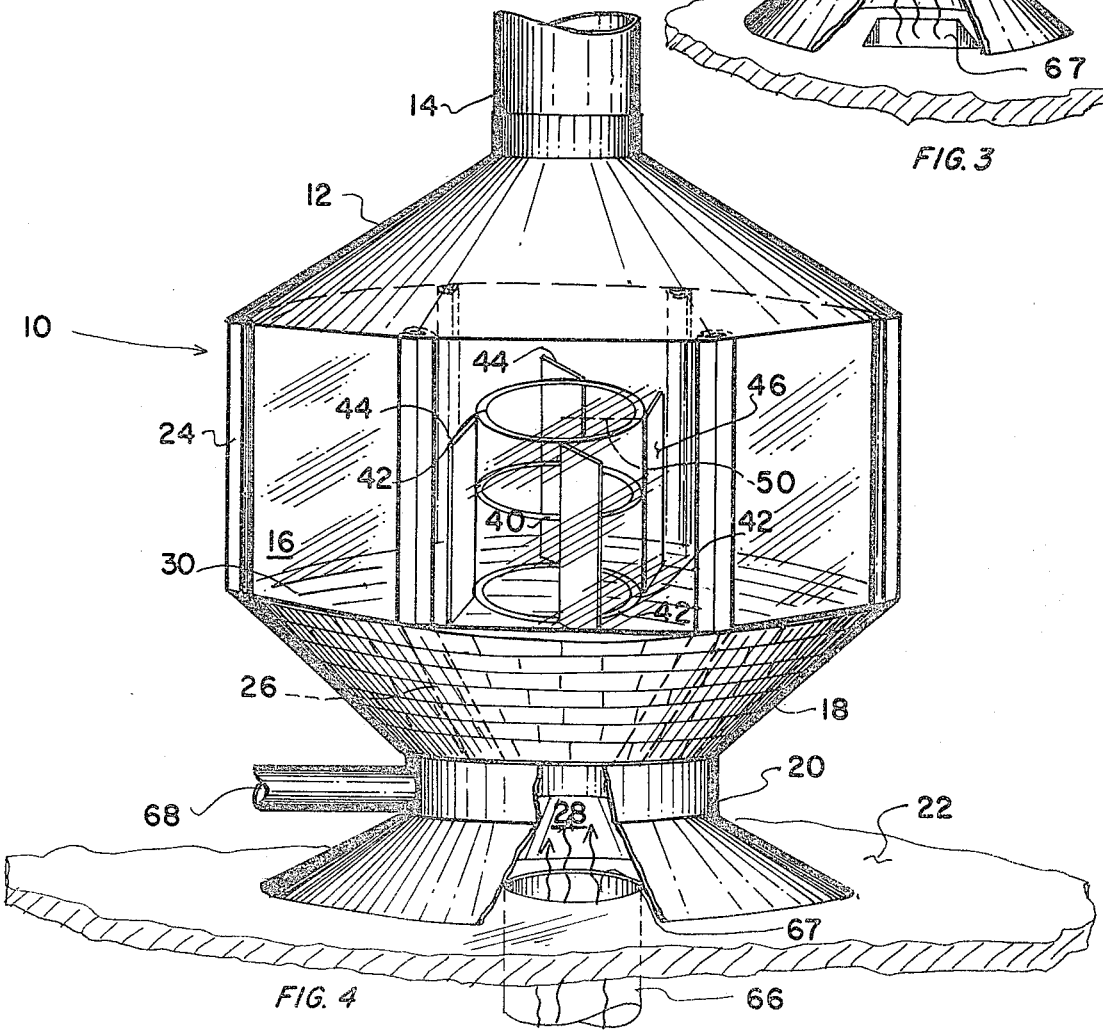
FIG. 4 is a perspective view of the invention.

Turning now descriptively to the drawings, in which similar reference characters denote similar elements throughout the several views, FIG. 4 illustrates the fireplace 10 which is formed with a conical metal hood 12 connected to a flue pipe 14, and resting on the top of transparent vertical side walls 16. Side walls 16 form a polygon in plan view being joined at their common vertical edges with sealing material or sealing strips. An upturned conical base 18 supports the side walls 16 and is mounted on a hollow pedestal section 20 that rests on a floor 22.

At spaced intervals about the interior of the side walls 16, and preferably at the vertical juncture of two such walls, vertical hollow air intake tubes 24 extend the height of the side walls. Each tube 24 is joined at its bottom end to a draft tube 26 that extends within the base 18 to the interior 28 of the pedestal. The base is filled with cemented refractory material 30 to form a floor for the fire chamber on which wood holder 40 rests.

Wood holder 40 is formed of a plurality of spaced concentric horizontal rings 42, all welded at their periphery to a plurality of vane-shaped legs 44. Each leg 44 is preferably in the form of a thin flat strip, with the exterior face surfaces 46 of the strip, each extending along a plane that extends, when seen from above, at an angle to a radial line 50 drawn from the juncture of the vane and the ring, with all face surfaces similarly oriented so as to direct air approaching from the exterior of the wood holder into a rotary path within the wood holder in a common circular direction.

The size of rings 42 is such as to permit a plurality of pieces of firewood 54 to be stacked vertically within the rings. I have found that circular rings, each of a diameter of twelve inches and fixed to vane legs so as to extend a height of twelve inches is satisfactory for common sizes of split firewood. The wood holder may be fixed to the refractory floor of the fire chamber. However, the vane legs which extend from the periphery of the rings furnishes excellent stability to a free standing wood holder, which may be lifted above the refractory floor for cleaning purposes.

Vertical air intake tubes 24 are each formed with an exterior open slit 62 along a trailing edge of the tube, as seen from above, with all slits oriented so as to impart a rotary motion in a common direction to air exiting from the slits, which direction is in the same circular direction as that to which the vane legs of the wood holder are oriented.

The interior 28 of the pedestal may be joined to an opening 67 under the floor, with an air intake duct 66 joined to opening 67 or alternatively a horizontal intake tube 68 may extend from the interior of the pedestal to exit through an exterior wall adjacent the fireplace.

Preferably the side walls may extend sixteen inches between base and hood, with opposed walls approximately thirty-two inches apart.

Figure 1:
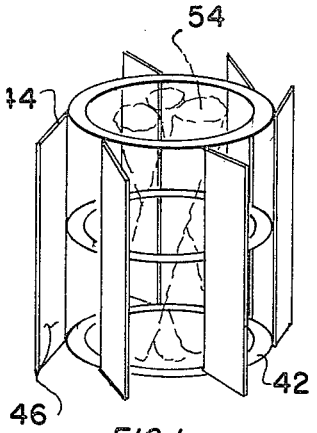
FIG. 1 is a perspective view of the wood holder of the invention.
Figure 2:
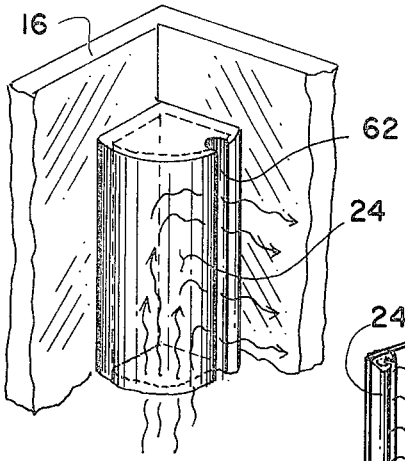
FIG. 2 is a detail perspective view of an air intake tube.
Figure 3:
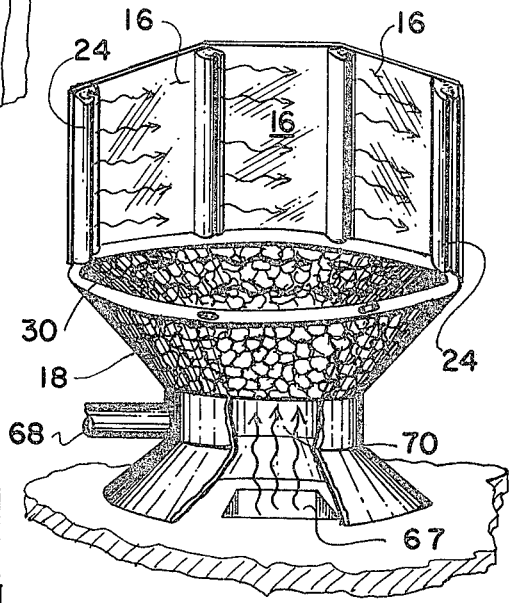
FIG. 3 is a detail perspective view of an alternative embodiment of the fire chamber and pedestal with the wood holder removed.

As shown in FIG. 3, alternatively the refractory section 30 at the base of the fire chamber may be suspended within the pedestal housing so as to provide an air intake chamber 70 between the refractory section 30 and the housing walls of the pedestal. Preferably, as shown in FIG. 4, the refractory section 30 extends to the housing walls of the pedestal, with air draft tubes 26 embedded in the refractory section 30.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An enclosed fireplace in which a fire chamber, fitted with means to introduce intake air into said chamber, is formed by vertical walls fitted with first non-moveable means to impart a rotational movement in the fire chamber, to intake air entering the fire chamber, with said fireplace fitted with second non-moveable means to impart a further rotational movement, in the same direction, to the air already in the fire chamber that approaches a central location of the fire chamber in which a supply of fuel may be located, so as to cause a rotating draft of intake air about burning fuel located in said central location of the fire chamber, in which the first said non-moveable means comprise a plurality of vertical tubes mounted in the fire chamber adjacent to the vertical walls of the chamber, with each tube joined at its base to a duct leading to a supply of intake air, and with a vertical exit slit extending substantially the length of each tube and located so as orient air exiting from said slit in a common circular direction in the fire chamber.

2. The combination as recited in claim 1, in which the second said means is in the form of a plurality of spaced joined vertical legs, locatable about the center of the fire chamber with each leg in the shape of a flat fin, and each located so as to orient air passing the legs in a common circular direction about the center of the fire chamber.

3. The combination as recited in claim 2 in which the vertical flat fins are joined together by a plurality of spaced circumferentially oriented means, which bars serve to both fix the fins in position and to form an enclosure that serves as retaining means for maintaining stacked firewood in a vertical position in the interior of the said second means.

4. The combination as recited in claim 3 in which the said means are in the form of circumferential rings.

5. The combination as recited in claim 3 in which the said means are fixed to the fins so that the fins extend substantially outwards of the enclosure bound by the bars.

6. The combination as recited in claim 3 in which the said means extend substantially in the horizontal direction, when the fins are aligned along their normal vertical axis.

7. An enclosed fireplace in which a fire chamber, fitted with means to introduce intake air into said chamber, is enclosed by vertical walls fitted with non-moveable means to impart a rotational movement, in the fire chamber, to intake air entering the fire chamber, so as to cause a rotating draft of intake air about burning fuel located in a central location of the fire chamber, in which the said means comprise a plurality of vertical tubes mounted in the fire chamber adjacent to the vertical walls of the chamber, with each tube joined at its base to a duct leading to a supply of intake air, and with a vertical exit slit extending substantially the length of each tube and located so as orient air exiting from said slit in a common circular direction in the fire chamber.

* * * * *